US009080818B2

(12) United States Patent
Maurer et al.

(10) Patent No.: US 9,080,818 B2
(45) Date of Patent: Jul. 14, 2015

(54) HEAT EXCHANGER WITH FOAM FINS

(75) Inventors: Scott M. Maurer, Haymarket, VA (US); Nicholas J. Nagurny, Manassas, VA (US); Michael R. Eller, New Orleans, LA (US); James W. Klett, Knoxville, TN (US)

(73) Assignee: Lockheed Martin Corporation, Bethesda, MD (US)

( * ) Notice: Subject to any disclaimer, the term of this patent is extended or adjusted under 35 U.S.C. 154(b) by 482 days.

(21) Appl. No.: 13/365,456

(22) Filed: Feb. 3, 2012

(65) Prior Publication Data

US 2012/0199334 A1 Aug. 9, 2012

Related U.S. Application Data

(60) Provisional application No. 61/439,562, filed on Feb. 4, 2011.

(51) Int. Cl.
*F28F 1/12* (2006.01)
*F28F 13/00* (2006.01)
*F28F 21/02* (2006.01)

(52) U.S. Cl.
CPC ..... *F28F 1/122* (2013.01); *F28F 13/003* (2013.01); *F28F 21/02* (2013.01); *F28F 2275/025* (2013.01)

(58) Field of Classification Search
USPC ..... 165/157, 158, 159, 166
See application file for complete search history.

(56) References Cited

U.S. PATENT DOCUMENTS 2,429,508 A 10/1947 Belaieff
2,792,200 A 5/1957 Huggins et al.
5,058,664 A * 10/1991 Gentry ..... 165/162
5,063,663 A * 11/1991 Casterline ..... 29/890.043
5,095,708 A 3/1992 Kalina
5,755,280 A * 5/1998 da Costa et al. ..... 165/140

(Continued)

FOREIGN PATENT DOCUMENTS

CN 2199467 5/1995
CN 2201284 6/1995

(Continued)

OTHER PUBLICATIONS

International Search Report for international application No. PCT/US2012/023788, dated Jul. 30, 2012 (4 pages).

(Continued)

*Primary Examiner* — Mohammad M Ali
*Assistant Examiner* — Raheena Rehman
(74) *Attorney, Agent, or Firm* — Hamre, Schumann, Mueller & Larson, P.C.

(57) ABSTRACT

Heat exchangers are described that employ fins made of a heat conducting foam material to enhance heat transfer. The foam fins can be used in any type of heat exchanger including, but not limited to, a plate-fin heat exchanger, a plate-frame heat exchanger or a shell-and-tube heat exchanger. The heat exchangers employing foam fins described herein are highly efficient, inexpensive to build, and corrosion resistant. The described heat exchangers can be used in a variety of applications, including but not limited to, low thermal driving force applications, power generation applications, and non-power generation applications such as refrigeration and cryogenics. The fins can be made from any thermally conductive foam material including, but not limited to, graphite foam or metal foam.

9 Claims, 16 Drawing Sheets

(56) References Cited

U.S. PATENT DOCUMENTS

| | | | | |
|---|---|---|---|---|
| 6,259,165 | B1 | 7/2001 | Brewington | |
| 6,673,328 | B1 | 1/2004 | Klett et al. | |
| 6,694,740 | B2 | 2/2004 | Nayar | |
| 7,013,963 | B2 | 3/2006 | Laine et al. | |
| 7,472,549 | B2 | 1/2009 | Brewington | |
| 7,857,039 | B2 * | 12/2010 | Nakamura | 165/157 |
| 8,020,610 | B2 * | 9/2011 | Soldner et al. | 165/82 |
| 2005/0109493 | A1 * | 5/2005 | Wu et al. | 165/157 |
| 2006/0124284 | A1 * | 6/2006 | Ushio et al. | 165/157 |
| 2006/0254757 | A1 * | 11/2006 | Kamsma | 165/163 |
| 2007/0228113 | A1 | 10/2007 | Dupree et al. | |
| 2007/0284095 | A1 * | 12/2007 | Wang et al. | 165/166 |
| 2008/0093059 | A1 * | 4/2008 | Nishida | 165/133 |
| 2008/0196869 | A1 * | 8/2008 | Behrens et al. | 165/104.33 |
| 2009/0126918 | A1 | 5/2009 | Campagna et al. | |
| 2009/0288814 | A1 * | 11/2009 | Stoia et al. | 165/185 |
| 2009/0308571 | A1 * | 12/2009 | Thompson et al. | 165/79 |
| 2009/0308582 | A1 | 12/2009 | Nagurny et al. | |
| 2010/0006273 | A1 | 1/2010 | Du et al. | |
| 2010/0181054 | A1 | 7/2010 | Nagurny et al. | |
| 2011/0011570 | A1 | 1/2011 | Levings et al. | |
| 2011/0011572 | A1 | 1/2011 | Nagurny et al. | |
| 2012/0199330 | A1 | 8/2012 | Maurer et al. | |
| 2012/0199331 | A1 | 8/2012 | Maurer et al. | |
| 2012/0199335 | A1 | 8/2012 | Maurer | |
| 2012/0282454 | A1 | 11/2012 | Jansen et al. | |

FOREIGN PATENT DOCUMENTS

| | | |
|---|---|---|
| CN | 1149707 | 5/1997 |
| CN | 1276515 | 12/2000 |
| EP | 1553379 | 7/2005 |
| EP | 2124009 | 11/2009 |

OTHER PUBLICATIONS

Written Opinion for international application No. PCT/US2012/023788, dated Jul. 30, 2012 (6 pages).

Spirax Sarco, "Vahterus PSHE Series Plate and Shell Heat Exchangers", found on http://www.spiraxsarco.com/pdfs/TI/p228_01.pdf, 2007, 2 pages.

Office Action issued for Chinese patent application No. 201280013029.2, dated Feb. 28, 2015 (28 pages, including English translation).

* cited by examiner

HEAT EXCHANGER WITH FOAM FINS

This application claims the benefit of U.S. Provisional Applicant Ser. No. 61/439,562, filed on Feb. 4, 2011, the entire contents of which are incorporated herein by reference.

FIELD

This disclosure relates to heat exchangers in general, and, more particularly, to heat exchangers employing fins made from a heat conducting foam material.

BACKGROUND

Heat exchangers are used in many different types of systems for transferring heat between fluids in single phase, binary or two-phase applications. Many different types of heat exchangers are known including plate-fin, plate-frame, and shell-and-tube heat exchangers. In plate-fin heat exchangers, a first fluid or gas is passed on one side of the plate and a second fluid or gas is passed on another side of the plate. The first fluid and/or the second fluid flow along channels between fins mounted on one side of the plate, and heat energy is transferred between the first fluid and second fluid through the fins and the plate. Materials such as titanium, high alloy steel, copper and aluminum are typically used for the plates, frames, and fins.

SUMMARY

This description relates to heat exchangers that employ fins made of a heat conducting foam material to enhance heat transfer. The foam fins can be used in any type of heat exchanger including, but not limited to, a plate-fin heat exchanger, a plate-frame heat exchanger or a shell-and-tube heat exchanger. The heat exchangers employing foam fins described herein are highly efficient, inexpensive to build, and corrosion resistant. The described heat exchangers can be used in a variety of applications, including but not limited to, low thermal driving force applications, power generation applications, and non-power generation applications such as refrigeration and cryogenics. The fins can be made from any thermally conductive foam material including, but not limited to, graphite foam or metal foam. In addition, the fins can be a combination of graphite foam fins, metal foam fins, and/or metal (for example aluminum) fins.

In one embodiment, a heat exchange unit includes first and second opposing plates that include surfaces that face each other, and a plurality of fins are disposed between the first and second opposing plates. Each fin has a first end connected to and in thermal contact with the surface of the first plate and a second end connected to and in thermal contact with the surface of the second plate. The fins define a plurality of fluid paths that extend generally from the second end to the first end, and the fins include graphite foam or metal foam. The first and second plates are made of a thermally conductive material, for example metal, and the fins may comprise, consist essentially of, or may consist of, graphite foam or metal foam.

In another embodiment, a heat exchange unit includes a plurality of fins disposed on a first major surface of a plate. Each fin has a first end connected to and in thermal contact with the first major surface and a second end spaced from the first major surface. The fins define a plurality of fluid paths that extend generally from the second end to the first end, and the fins include, consist essentially of, or consist of, graphite foam or metal foam.

In another embodiment, a plate-fin heat exchange unit includes a plate or frame that includes first and second opposing major surfaces and first and second opposing ends, and a plurality of enclosed fluid flow channels extending through the frame from the first end to the second end. The enclosed fluid flow channels do not extend through the first and second opposing major surfaces. In addition, the plate-fin heat exchange unit includes a plurality of fins disposed on the first major surface, each fin having a first end connected to and in thermal contact with the first major surface and a second end spaced from the first major surface, the fins defining a plurality of fluid paths that extend generally from the second end to the first end, and the fins include graphite foam or metal foam. The frame may be made of metal, and the fins comprise, consist essentially of, or consist of graphite foam or metal foam.

An embodiment of a plate-fin heat exchanger may also include a housing, a first inlet and a first outlet for a first fluid, a second inlet and a second outlet for a second fluid, and the plate-fin heat exchange unit disposed inside the housing.

DETAILED DESCRIPTION

The following description describes examples of heat exchangers that employ fins made of graphite foam to enhance heat transfer. The fins can comprise, consist essentially of, or consist of graphite foam or other type of foam material that facilitates heat exchange. The graphite foam fins can be used in any type of heat exchanger including, but not limited to, a plate-fin heat exchanger, a plate-frame heat exchanger or a shell-and-tube heat exchanger.

Although the description focuses on graphite foam fins, the fins can alternatively be made of metal foam. In some embodiment, the fins can be metal fins, such as aluminum fins. In addition, in some embodiments, the heat exchanger and heat exchange units can include a combination of graphite foam fins, metal foam fins and/or metal (such as aluminum) fins.

The fluids described in the examples herein can be liquids or vapors/gases, and one or both of the fluids can retain their phase during heat transfer (e.g. remain a liquid or vapor) or change phase (e.g. liquid turns to vapor; vapor turns to liquid; etc.).

Figure 1:
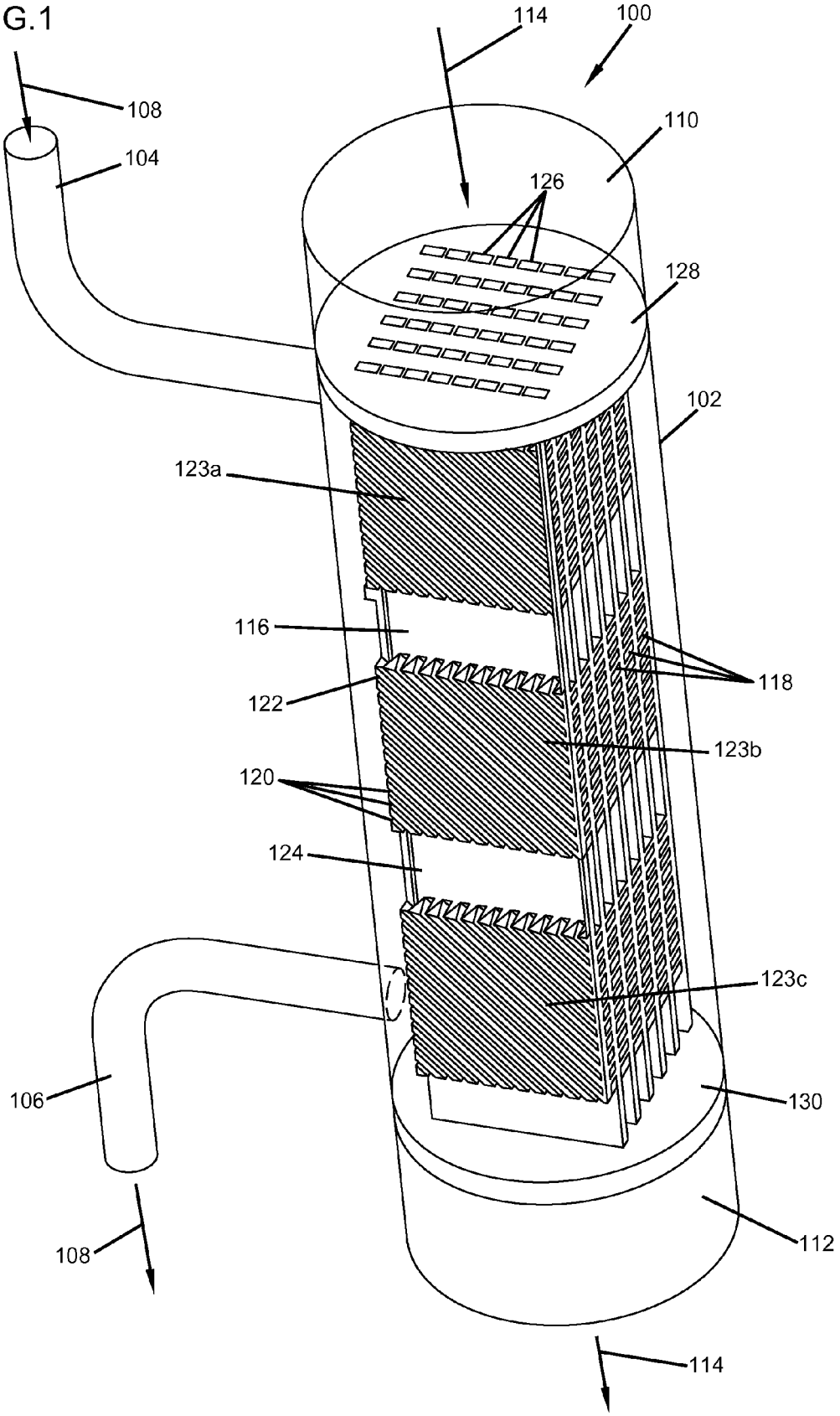
FIG. 1 shows an embodiment of a heat exchanger described herein.

FIG. 1 shows an embodiment of a shell-and-tube heat exchanger 100 that includes a housing 102, a first inlet 104 and a first outlet 106 for a first fluid 108, and a second inlet 110 and a second outlet 112 for a second fluid 114. The heat exchanger 100 is configured to exchange heat between the first fluid 108 and the second fluid 114 as the two fluids flow through the heat exchanger 100.

The heat exchanger 100 includes a plate-fin tube bundle 116 disposed inside the housing 102, the tube bundle 116 being made of one or more plate-fin heat exchange units 118. The heat exchange units 118 define fluid paths 120 through which the first fluid 108 can flow, as well as define fluid channels 126 through which the second fluid 114 can flow separated from the first fluid 108.

Each heat exchange unit 118 is constructed of a plurality of fins 122 connected to and in thermal contact with a plate 124. As described in more detail below, each plate 124 comprises a pair of opposing plates separated by side plates and intermediate plates, which together define the fluid channels 126. The fins 122 are suitably mounted on the exterior surface of one of the opposing plates.

The fins 122 can take on any number of configurations depending upon, for example, the application and heat transfer requirements. For example, in the embodiment illustrated in FIG. 1, the fins 122 can be separated into a plurality of regions 123*a*, 123*b*, 123*c*. Each region can be tailored to perform a specific heat transfer function. For example, in an evaporator application, the region 123*a* can be configured as a pre-heat zone which functions to pre-heat one of the fluids; the region 123*b* can be configured as a two-phase transition zone for liquid-vapor transfer; and the region 123*c* can be configured as a vapor region to maximize transition to vapor before the vapor flows from the housing. Not only can the fins 122 be separated into regions, but the design, configuration and material of the fins in each region can vary to aid in performing the specific task required by that region. Although FIG. 1 shows three regions, the fins can be separated into a smaller or larger number of regions. Further, the fins need not be separated into regions; instead, each heat exchange unit 118 can be continuous along the length of the plate 124 so as to comprise a single region.

In FIG. 1, the fins 122 are shown to have a diagonal linear configuration. Other configurations of the fins are possible and described in detail below. The fluid paths 120 are defined by the fins 122 on the plate 124 of the heat transfer unit 118. The fins 122 and the plate 124 are made of thermally conductive materials.

Figure 2A:
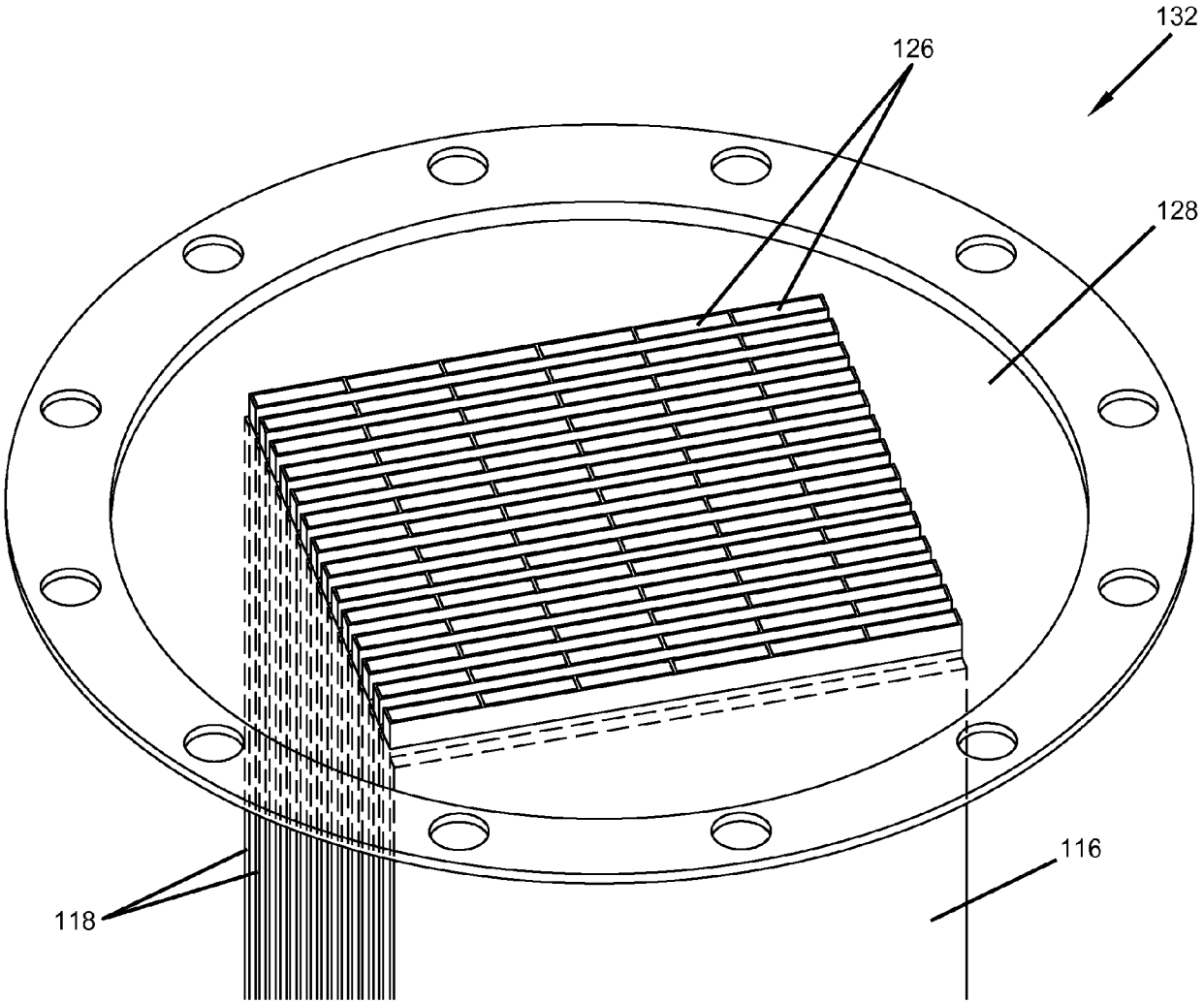
FIG. 2A shows an enlarged view of an end of the tube bundle of the heat exchanger shown in FIG. 1.
Figure 2B:
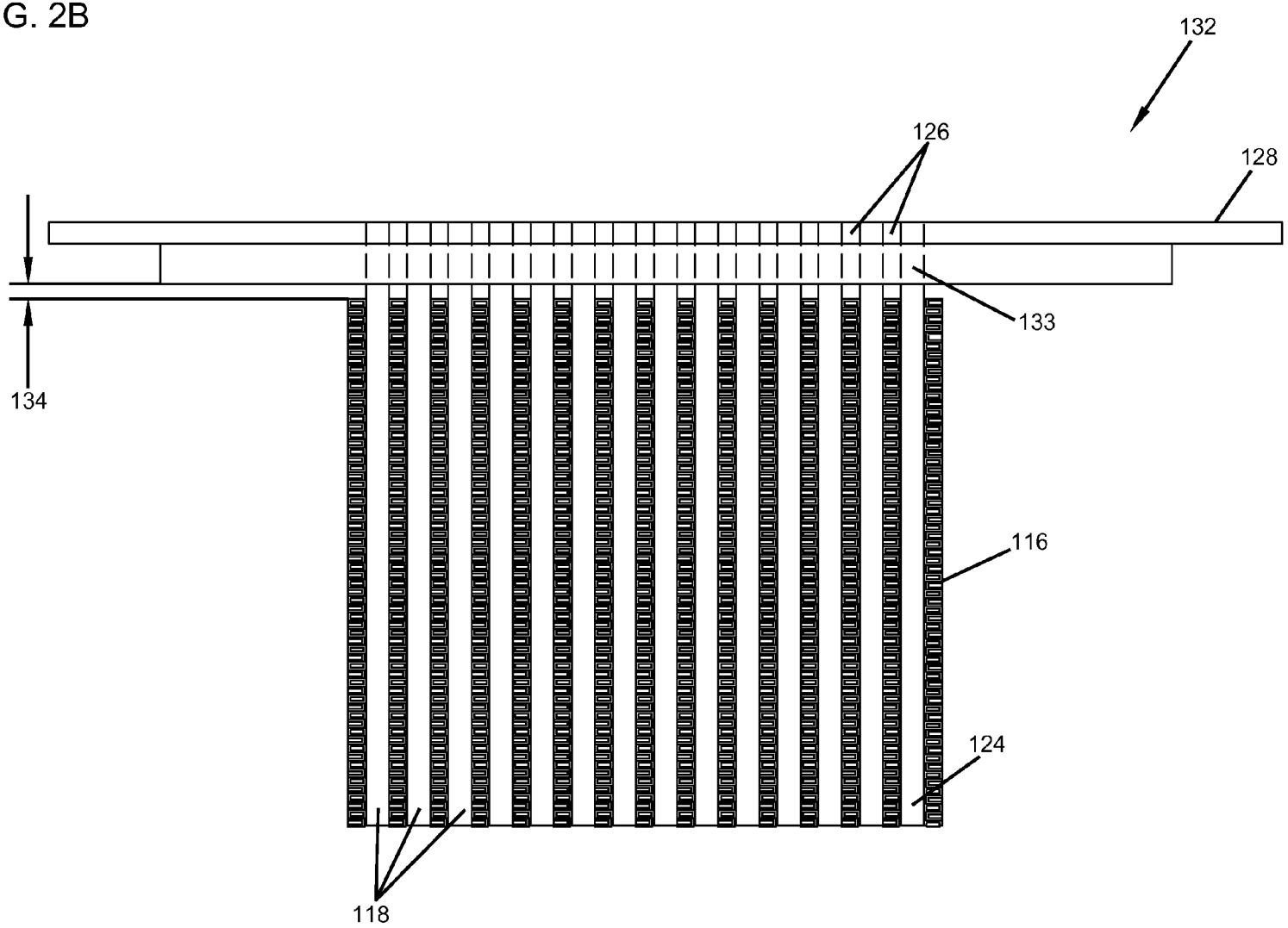
FIG. 2B shows a side view of the end of the tube bundle in FIG. 2A.

As illustrated in FIGS. 1, 2A and 2B, the ends of the plates 124 of the tube bundle 116 are secured to a first facesheet 128 at one end and to a second facesheet 130 at the opposite end. The facesheets 128, 130 are sealed to the housing 102 so that the second fluid 114 flows into the channels 126 and out the outlet end 112 separated from the fluid 108 that flows within the interior space of the housing 102. The inlet 104 and the outlet 106 are located on the housing between the facesheets 128, 130 so that the first fluid 108 is contained between the facesheets 128, 130 as it flows through the fluid paths 120.

The channels 126 of each heat exchange unit 118 extend from and through the first facesheet 128 at the second inlet 110 to and through the second facesheet 130 at the second outlet 112. The channels 126 are configured to keep the second fluid 114 fluidically isolated from the first fluid 108 to prevent mixing of the two fluids. However, each heat exchange unit 118 is configured to exchange heat between the fluids 108, 114. For example, if the second fluid 114 is at a higher temperature than the first fluid 108, each heat exchange unit 118 is configured to transfer heat from the second fluid 114 flowing in the channels 126 through the plate 124 and the fins 122 to the first fluid 108 flowing in the fluid paths 120 and in contact with the fins. Likewise, in the case where the first fluid is at a higher temperature than the second fluid 114, heat is transferred from the first fluid via the fins and the plate 124 into the second fluid. As discussed further below with respect to FIGS. 7A-E and FIG. 8A-E, baffles can be employed on the tube bundle 116 to ensure a particular pattern of flow of the fluid 108 within the housing 102.

FIGS. 2A and 2B show enlarged top perspective and side views, respectively, of an end 132 portion of the tube bundle 116 at the second inlet side of the heat exchanger 100. Each plate 124 has an extension 133 at each end that define the inlets and outlets, respectively, of the channels 126. The extension at the end that is connected to the facesheet 130 is visible in FIG. 1. The extensions 133 of the plates 124 are attached to the first facesheet 128 to define discrete inlets to the separate channels 126. Likewise, the extensions are attached to the second facesheet 130 at its opposite end in a similar manner, to define discrete outlets for the channels 126.

The extensions 133 of the heat exchange units 118 may be attached to the facesheets 128, 130 by bonding, brazing, welding, and/or other suitable attachment methods. In an embodiment, the extensions 133 and the facesheets 128, 130 are attached by friction stir welding (FSW).

FSW is a known method for joining elements of the same material. Immense friction is provided to the elements such that the immediate vicinity of the joining area is heated to temperatures below the melting point. This softens the adjoining sections, but because the material remains in a solid state, the original material properties are retained. Movement or stirring along the weld line forces the softened material from the elements towards the trailing edge, causing the adjacent regions to fuse, thereby forming a weld. FSW reduces or eliminates galvanic corrosion due to contact between dissimilar metals at end joints. Furthermore, the resultant weld retains the material properties of the material of the joined sections. Further information on FSW is disclosed in U.S. Patent Application Publication Number 2009/0308582, titled Heat Exchanger, filed on Jun. 15, 2009, which is incorporated herein by reference.

The facesheets 128, 130 are formed from the same material as the plates 124 of the heat exchange units 118. Materials suitable for use in forming the plates 124 and the facesheets 128, 130 include, but are not limited to, marine grade aluminum alloys, aluminum alloys, aluminum, titanium, stainless-steel, copper, bronze, plastics, and thermally conductive polymers.

The fins described herein can be made partially or entirely from foam material. In one example, the fins can consist essentially of, or consist of, foam material. The foam material may have closed cells, open cells, coarse porous reticulated structure, and/or combinations thereof. In an embodiment, the foam can be a metal foam material. In an embodiment, the metal foam includes aluminum, copper, bronze or titanium foam. In another embodiment, the foam can be graphite foam. In an embodiment, the fins do not include metals, for example aluminum, titanium, copper or bronze. In an embodiment, the fins are made only of graphite foam having an open porous structure. In addition, in some embodiments, the heat exchanger and heat exchange units can include a combination of graphite foam fins, metal foam fins and/or metal (such as aluminum) fins.

As shown in FIG. 2B, gaps 134 formed by the extensions 133 are provided between the fins 122 and the facesheet 128. Similar gaps are provided at the opposite end. Accordingly, at the gaps 134, the tube bundle 116 is shown to be devoid of fins 122. The extensions 133 penetrate through the facesheet 128 to facilitate attachment to the facesheet 128.

The tube bundle 116 is formed from a plurality of the heat exchange units 118 stacked together. When the heat exchange units are stacked, the channels 126 defined by the plates 124 form an array of fluid channels for the fluid 114 to flow through the tube bundle 116 from the inlet 110 to the outlet 112. Also, the fluid paths 120 for the fluid 108 are defined between the fins 122 and the plates 124. As evident from FIG. 2B, for intermediate ones of the heat exchange units 118 in the tube bundle 116, free ends of the fins 122 of the intermediate plates 124 are attached to adjacent plates so that the stack of heat exchange units 118 form an integral unit. However, the heat exchange units 118 need not be integrally attached together in the tube bundle, which would facilitate replacement of a heat exchange unit if a heat exchange unit for some reason needs to be replaced.

The fins 122 of the heat exchange units 118 shown in FIG. 1 have diagonal linear configurations. FIGS. 3-6 show additional embodiments of plate-fin heat exchange units that can be used in a plate-fin tube bundle. The heat exchange units in FIGS. 3-6 are similar to the heat exchange units 118 in that they include a plate 150 similar to the plate 124 and foam fins. However, the construction of the fins differ. FIGS. 3-6 also show additional detail of the plates 150.

In FIGS. 3-6, the plurality of fins are joined to the plate 150 to form a thermal transfer path between first and second fluid streams. The fins and the plate 150 may be joined using, for example, adhesive bonding, welding, brazing, epoxy, and/or mechanical attachment. If adhesive bonding is used, the adhesive can be thermally conductive. The thermal conductivity of the adhesive can be increased by incorporating ligaments of highly conductive graphite foam, with the ligaments in contact with the surface of the plate and the adhesive forming a matrix around the ligaments to keep the ligaments in intimate contact with the plate. The ligaments will also enhance bonding strength by increasing resistance to shear, peel and tensile loads.

Figure 3:
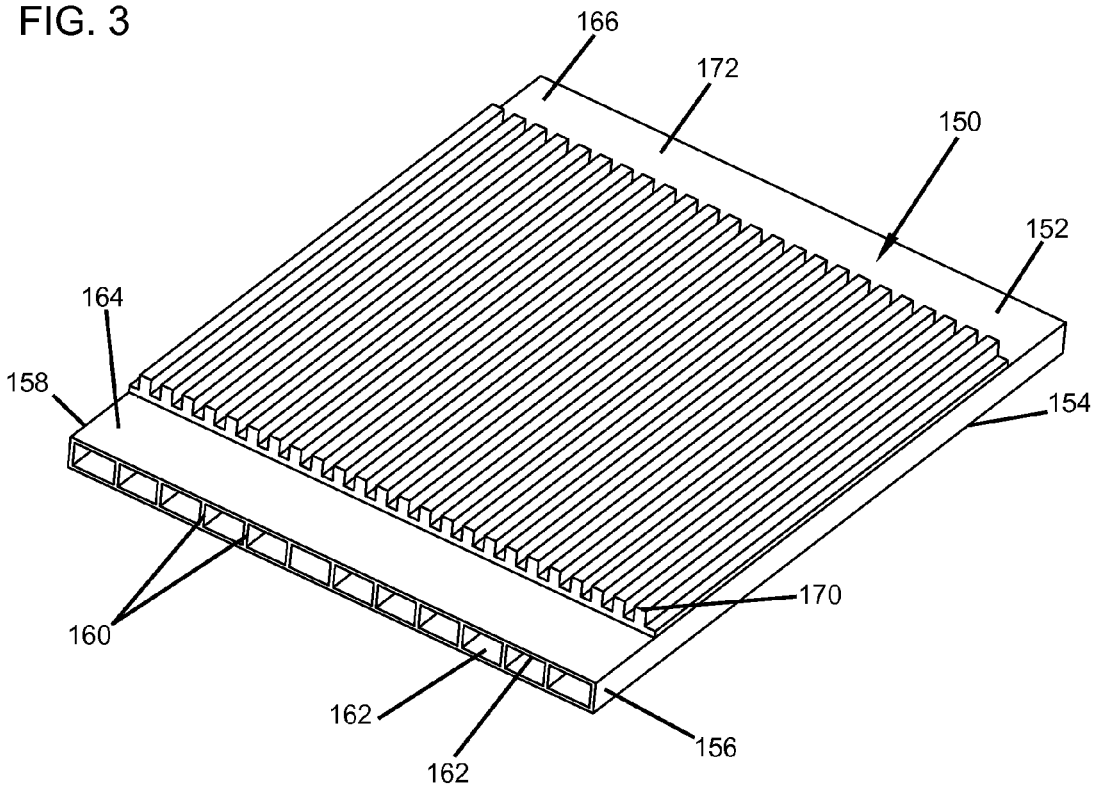
FIG. 3 shows another embodiment of a plate-fin heat exchange unit.
Figure 4:
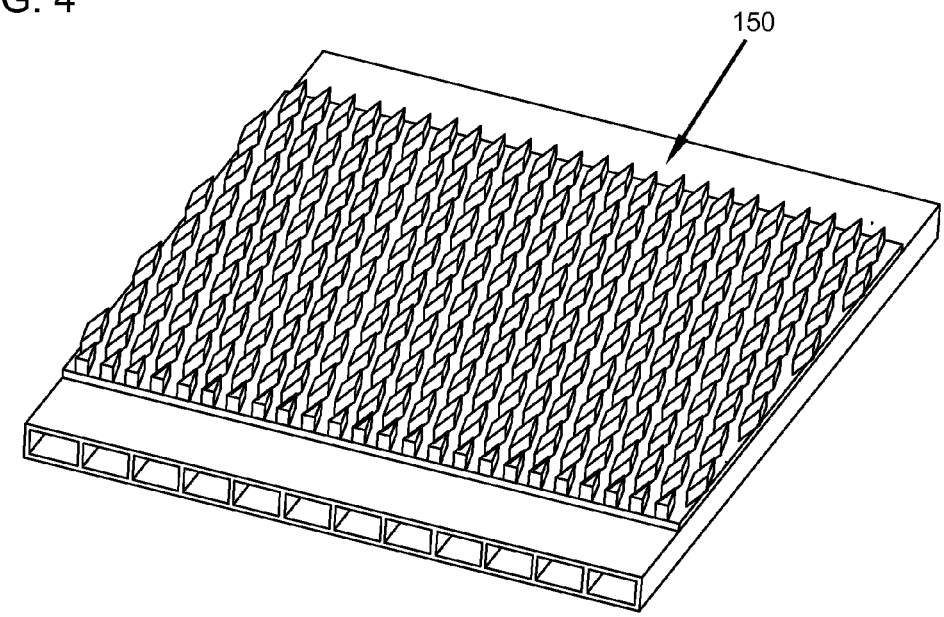
FIG. 4 shows yet another embodiment of a plate-fin heat exchange unit.
Figure 5:
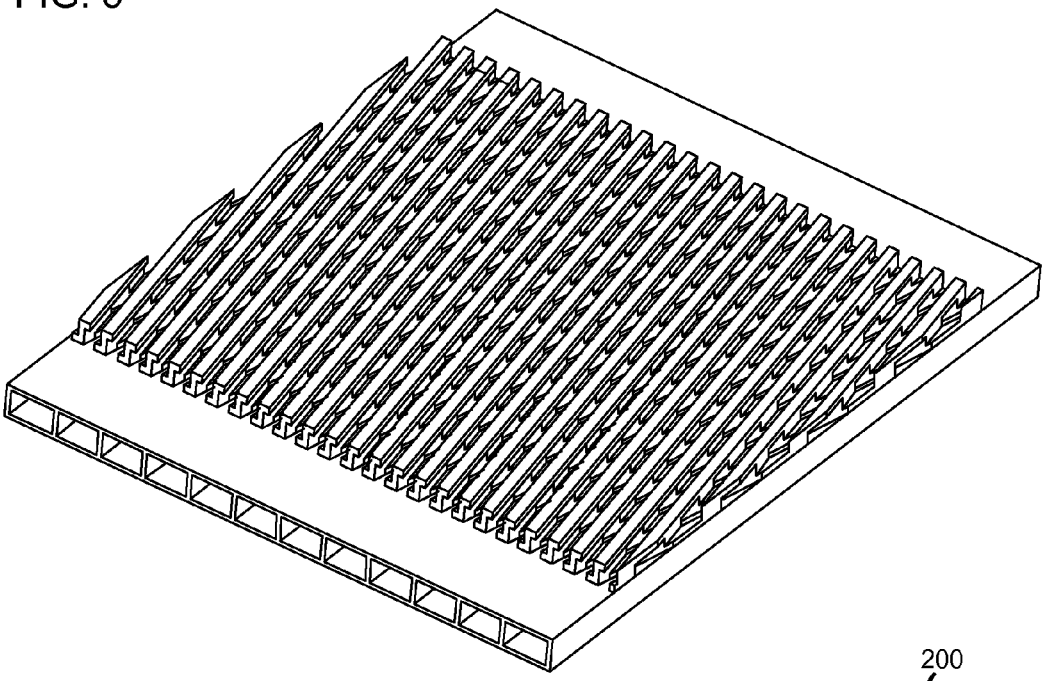
FIG. 5 shows yet another embodiment of a plate-fin heat exchange unit.
Figure 6:
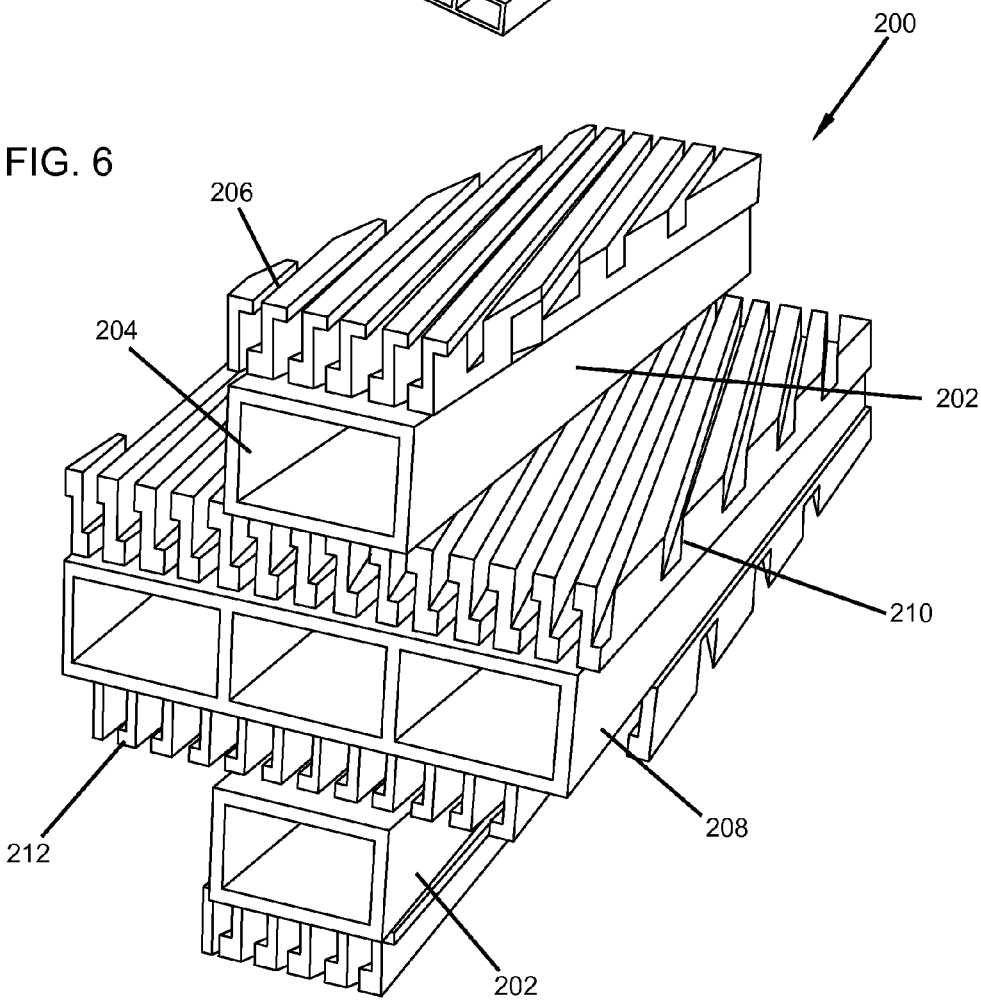
FIG. 6 shows another example of a plate-fin tube bundle that can be employed in the heat exchanger of FIG. 1.

The plate 150 will be described with reference to FIG. 3, it being understood that the plates 150 in FIGS. 4-6 are constructed in similar manner. With reference to FIG. 3, the plate 150 comprises a first plate 152 and a second opposing plate 154 separated from each other by side plates 156, 158 and a plurality of intermediate plates 160. The plates 152, 154, the side plates 156, 158 and the intermediate plates 160 collectively define a frame. The first plate 152 and the second plate 154 have interior opposing surfaces facing toward one another to which the side plates 156, 158 and the intermediate plates 160 are secured. The plates 152, 154, the side plates 156, 158 and the intermediate plates 160 define a plurality of enclosed fluid flow channels 162 extending through the frame from a first end 164 to a second end 166. The enclosed fluid flow channels 162 do not extend through the plates 152, 154 or the first and second opposing major surfaces thereof. The plate 150 may be formed by an extrusion process, wherein the plate 150 is formed to be a single unit of a single material. Thus, the plate 150 can be formed to not have any galvanic cells and/or galvanic joints.

The fins 170 are disposed on an outward facing, first major surface 172 of the plate 152, with each fin 170 having a first end connected to and in thermal contact with the surface 172 of the plate 152. Each fin 170 also has a second end spaced from the surface 172. Fluid paths are defined by the fins and the surface 172 extending generally from the second end of the fins to the first ends of the fins.

In FIG. 3, the fins 170 are illustrated as being elongated, linear and rectangular in shape. The fins 170 also have a substantially flat top for stacking with the surface of a plate or frame of another heat exchange unit when stacked with other heat exchange units to form a tube bundle. The fins 170 extend generally parallel to the intended or primary direction of flow of fluid past the fins. However, the fins 170 could be disposed at any suitable angle relative to the primary fluid flow direction, for example from 0 to less than about 90 degrees from the flow direction.

FIG. 4 shows a heat exchange unit similar to the heat exchange unit of FIG. 3, with diamond-shaped fins on the plate 150, with the fins having substantially flat top surfaces for stacking with the surface of a plate or frame of another heat exchange unit.

FIG. 5 shows a heat exchange unit similar to the heat exchange unit of FIG. 3, with fins having a cross corrugated diamond-shaped configuration and having substantially flat top surfaces for stacking with the surface of a plate or frame of another heat exchange unit.

An "X"-degree cross corrugated diamond-shaped configuration is used herein to mean, when viewed from the top perspective, a configuration wherein a first straight portion of the fins and a second straight portion of the fins is provided in a crisscross configuration forming substantially diamond-shaped holes. The numerical value for X indicates the vertical angle at an intersection of the first and the second straight portions, when the fins are viewed from the top. The value for X can range anywhere from about zero degrees to less than about 90 degrees.

Other arrangements of fins are possible as discussed below in FIGS. 14A-M. In addition, the fins are not limited to extending from one side of the plate 150 only. For example, it is contemplated that two adjacent, facing plates could have respective foam fins extending toward the other facing plate. The fins on the facing plates could fit together like fingers with a small gap between them. If necessary, a fixed separator can be provided to keep the fins separated.

FIG. 6 shows an alternative embodiment of a plate-fin tube bundle 200 that can be disposed within a shell such as the housing 102 of FIG. 1. The tube bundle 200 is formed by a plurality of heat exchange units stacked together into a desired arrangement. In the illustrated embodiment, the tube bundle 200 includes a heat exchange unit comprised of a plate 202 that defines a single fluid passageway 204, and a plurality of foam fins 206 on the upper surface of the plate. The plate 202 essentially forms a non-circular tube defining the fluid passageway 204. The tube bundle 200 also includes a center heat exchange unit comprised of a center plate 208 that defines a plurality of the fluid passageways 204, with foam fins 210, 212 on opposite outward facing surfaces of the plate 208. The tube bundle 200 also includes a lower heat exchange unit comprised of another one of the plates 202 that defines the single fluid passageway 204, and a plurality of the foam fins 206 on the lower surface of the plate. In use, the heat exchange units are secured together in a stack to form the tube bundle, with the tube bundle secured at opposite ends to face sheets in a similar manner as discussed above for FIGS. 1, 2A and 2B.

Figure 9:
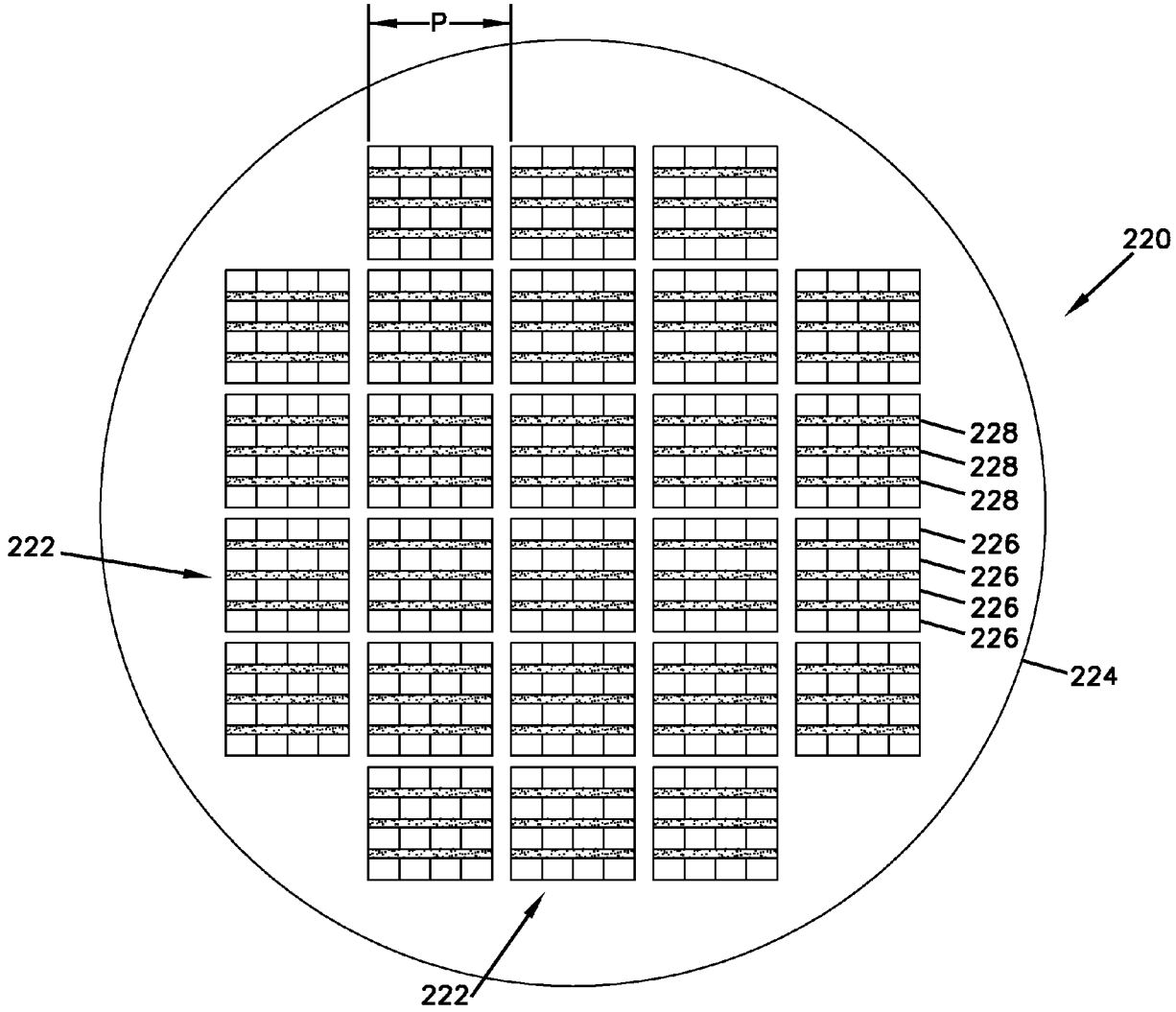
FIG. 9 illustrates an exemplary arrangement of multiple plate-fin tube bundles within a shell.

The tube bundle 200 can be used by itself in the shell or arranged with other tube bundles in the shell. Also, other configurations of tube bundles are possible. For example, FIG. 9 illustrates a shell-and-tube heat exchanger 220 with a plurality of separate plate-fin tube bundles 222 disposed within a shell 224. Each tube bundle 222 comprises a plurality of plates 226 defining fluid flow passages, with foam fins 228 disposed between the plates. The tube bundles 222 are spaced from each other with a horizontal pitch P, defined as the distance between a side of one tube bundle 222 and the side of the next adjacent tube bundle. The tube bundles can also have a vertical pitch that is the same as or different than the horizontal pitch. As would be apparent to a person of ordinary skill in the art, the number of tube bundles, the size of each tube bundle, and the pitch of the tube bundles can vary depending in part upon the heat exchange requirements of the particular application.

Figure 7A:
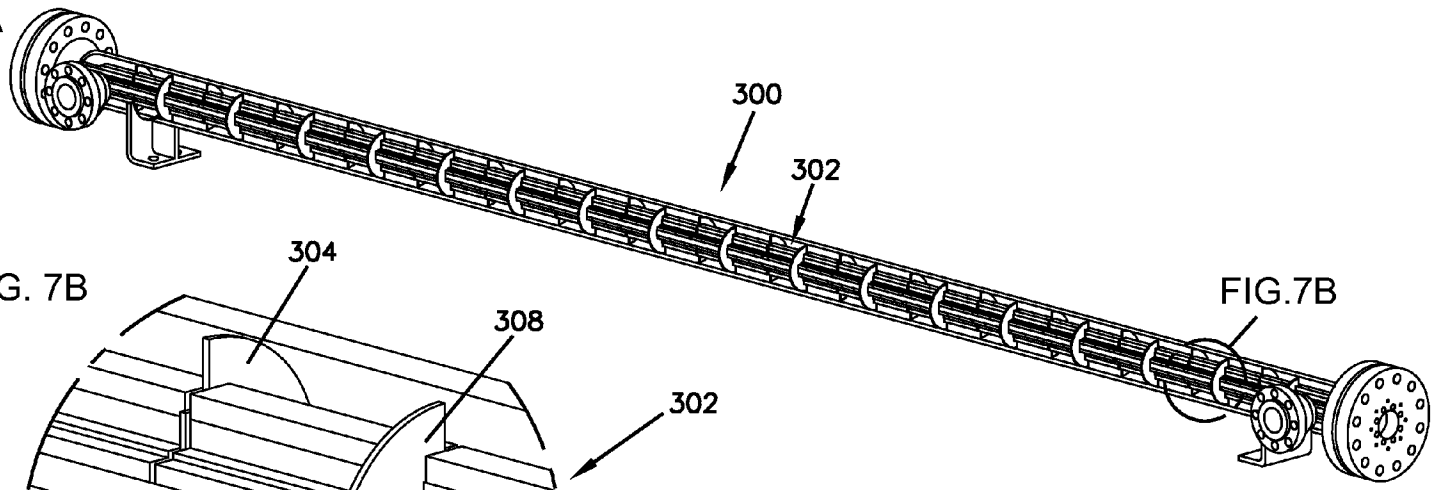
FIG. 7A shows a shell-and-tube heat exchanger employing a plate-fin tube bundle with baffles.
Figure 7B:
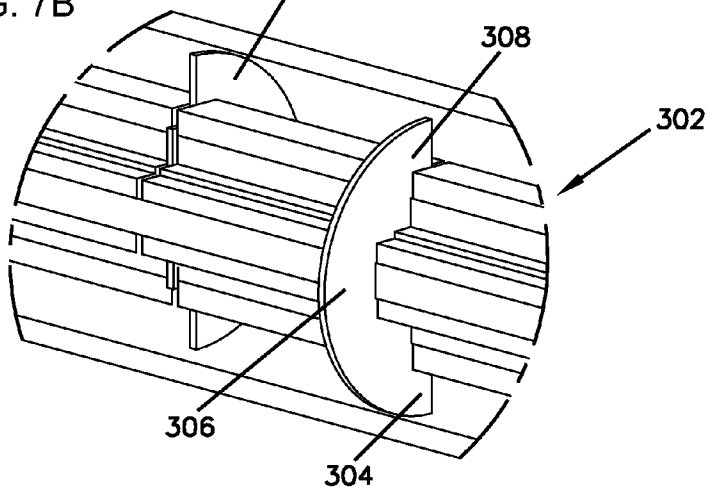
FIG. 7B is an enlarged view of the portion contained in the circle 7B in FIG. 7A.
Figure 7C:
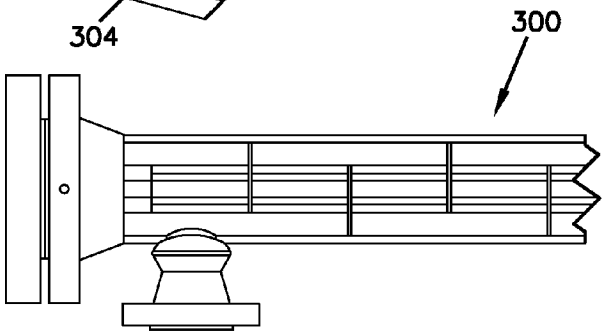
FIG. 7C is a side view of the heat exchanger of FIG. 7A showing the flow path within the shell.

FIGS. 7A-C show a shell-and-tube heat exchanger 300 employing a plate-fin tube bundle 302 with baffles 304. In the illustrated embodiment, the tube bundle 302 is similar to the bundle 200 in FIG. 6. However, the baffles 304 can be used with the plate-fin tube bundle 116 in FIG. 1, the plate-fin tube bundles 222 in FIG. 9, or can be used with any plate-fin tube bundle configuration.

The baffles 304 comprise plates that help to support the bundle 302 with the shell, and to create a desired flow pattern of the fluid within the shell. Any type or configuration of baffling can be used to achieve any desired flow pattern. The baffles 304 can be made of any material suitable for accomplishing the tasks of the baffles 304, for example aluminum.

In the illustrated embodiment, the baffles 304 are substantially semicircular in shape and include an outer edge 306 that matches the interior surface of the shell to prevent or minimize the flow of fluid between the outer edge 306 and the shell. The baffles 304 also include slots 308 that allow the various parts of the tube bundle to be inserted through the slots during installation.

In FIGS. 7A-C, the baffles are disposed at spaced locations on the tube bundle 302 at alternating 180 degree locations. As a result, as illustrated by the arrows in FIG. 7C, the baffles 304 cause the fluid to flow in cross-flow directions relative to the axis of the tube bundle 302 (i.e. a side-side flow). The particular locations, spacing, and shapes of the baffles 304 can vary greatly depending in part upon the type of flow pattern that one wishes to achieve with in the shell.

Figure 7D:
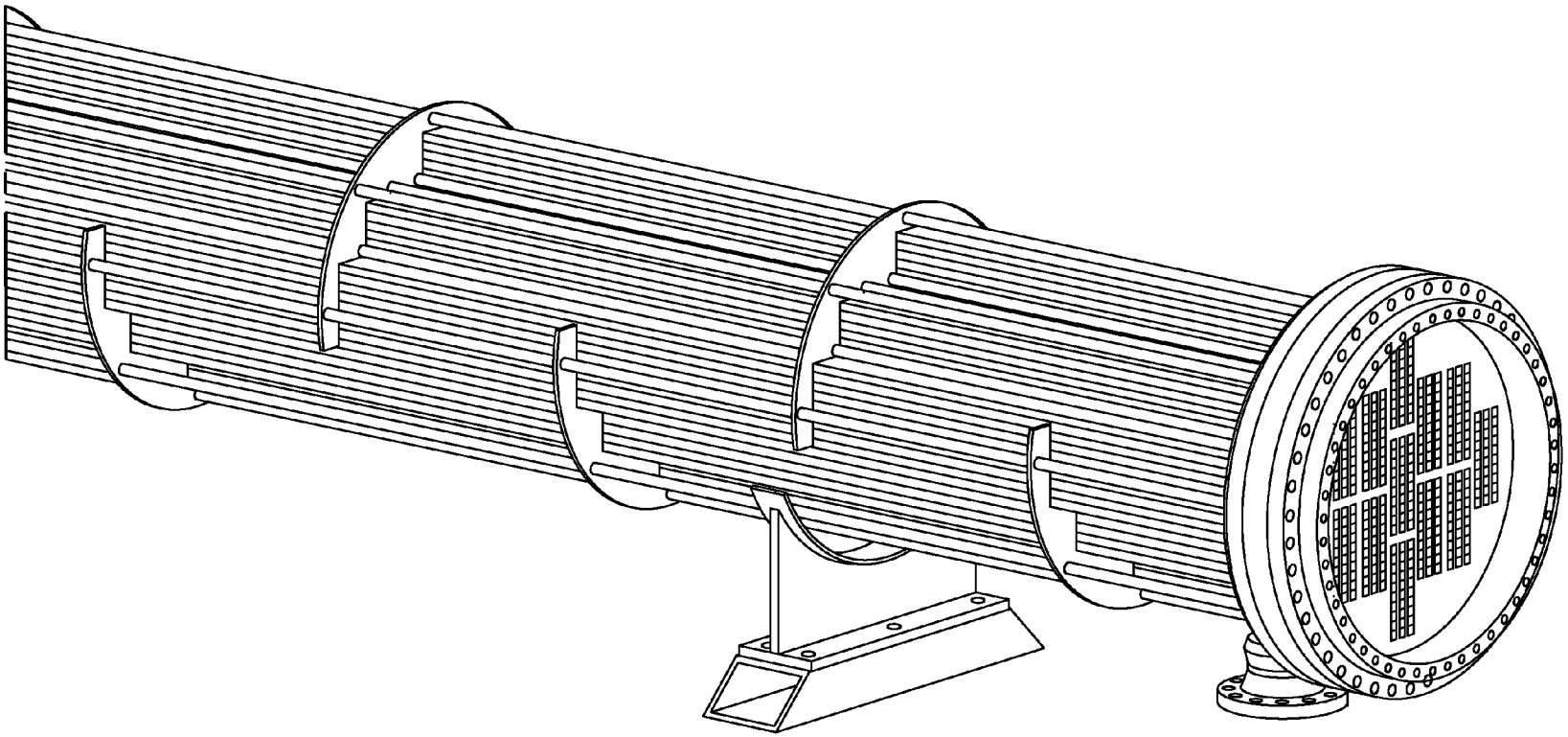
FIG. 7D shows an example of semicircular baffles with slots for passage of the tube bundle.
Figure 7E:
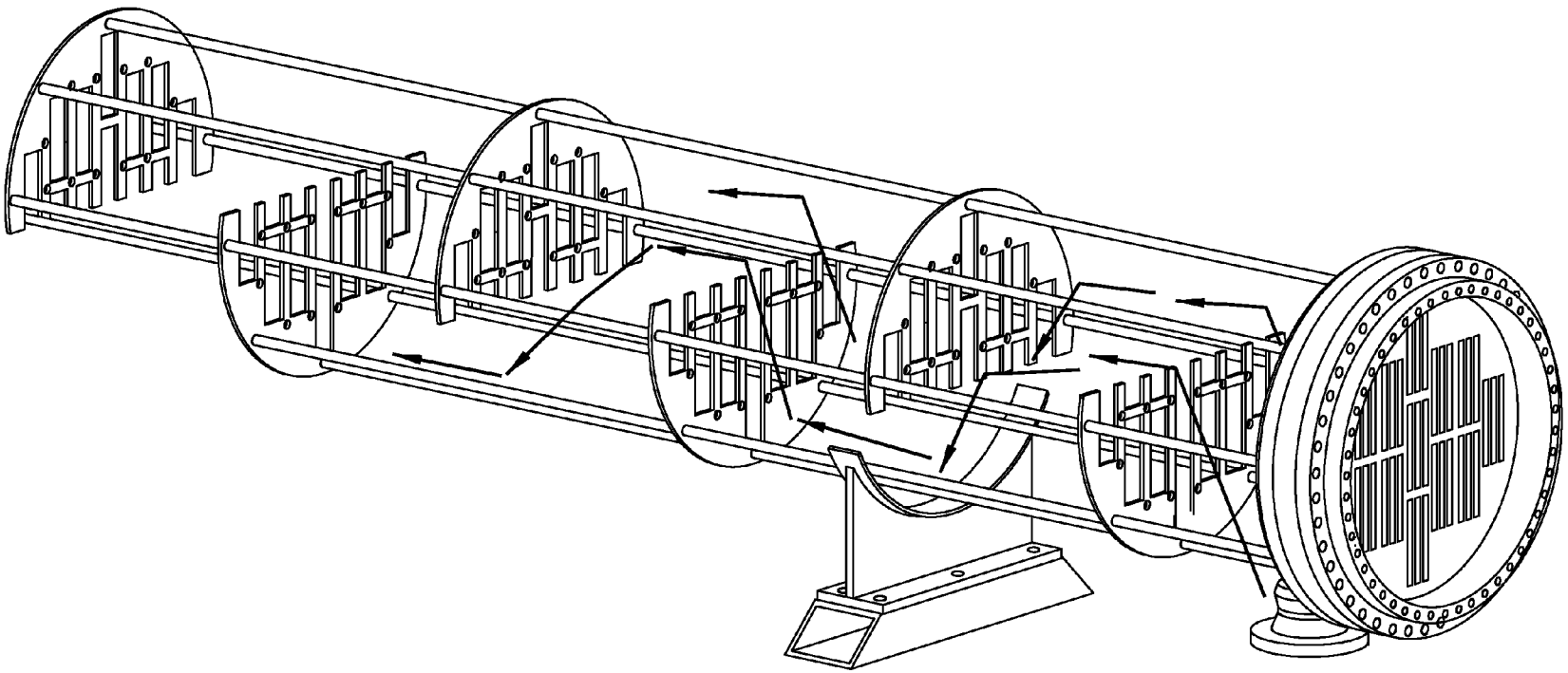
FIG. 7E is a view similar to FIG. 7D but with the tube bundle removed.

FIGS. 7D-E show semicircular baffles with slots for passage of the tube bundle, with the arrows in FIG. 7E showing an approximation of the flow path of fluid past the baffles.

Figures 8A, 8B, 8C:
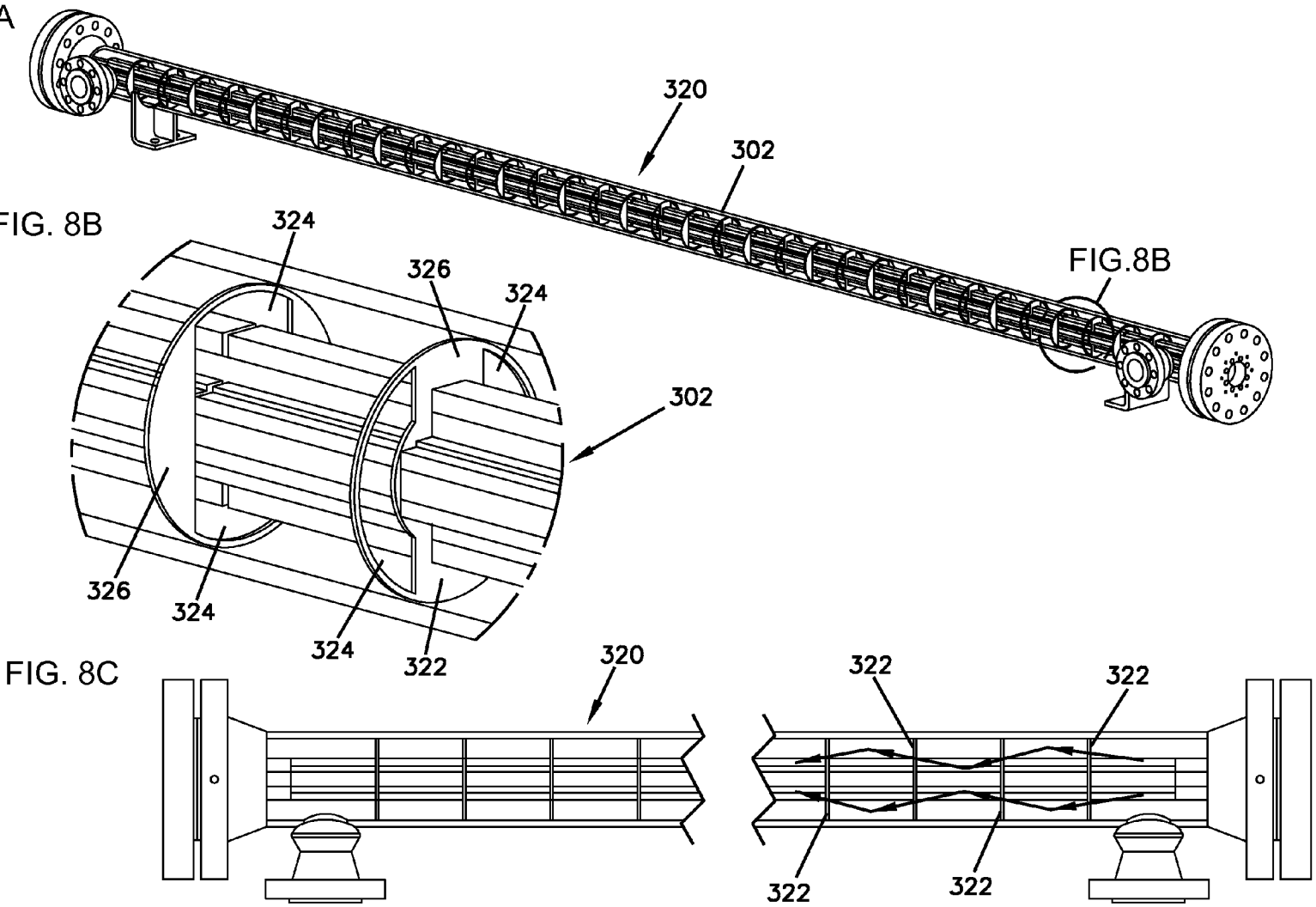
FIG. 8A shows another example of a shell-and-tube heat exchanger employing a plate-fin tube bundle with baffles.
FIG. 8B is an enlarged view of the portion contained in the circle 8B in FIG. 8A.
FIG. 8C is a side view of the heat exchanger of FIG. 8A showing the flow path within the shell.

FIGS. 8A-C illustrate another example of a shell-and-tube heat exchanger 320 employing the plate-fin tube bundle 302 of FIGS. 7A-C along with baffles 322. The baffles 322 comprise generally circular plates with cut-out sections 324 and solid sections 326. The baffles are arranged in alternating fashion such that the cut-out sections of one baffle alternate with the solid sections of the next adjacent baffle. The result is the flow pattern illustrated by the arrows in FIG. 8C, where the flow is generally parallel to the axis of the tube bundle 302 with a slight change in flow direction as the fluid flows through the cut-out sections 324 of one baffle and flow to the cut-out sections 324 of the next baffle (i.e. a side-top-side or swirling flow).

Figure 8D:
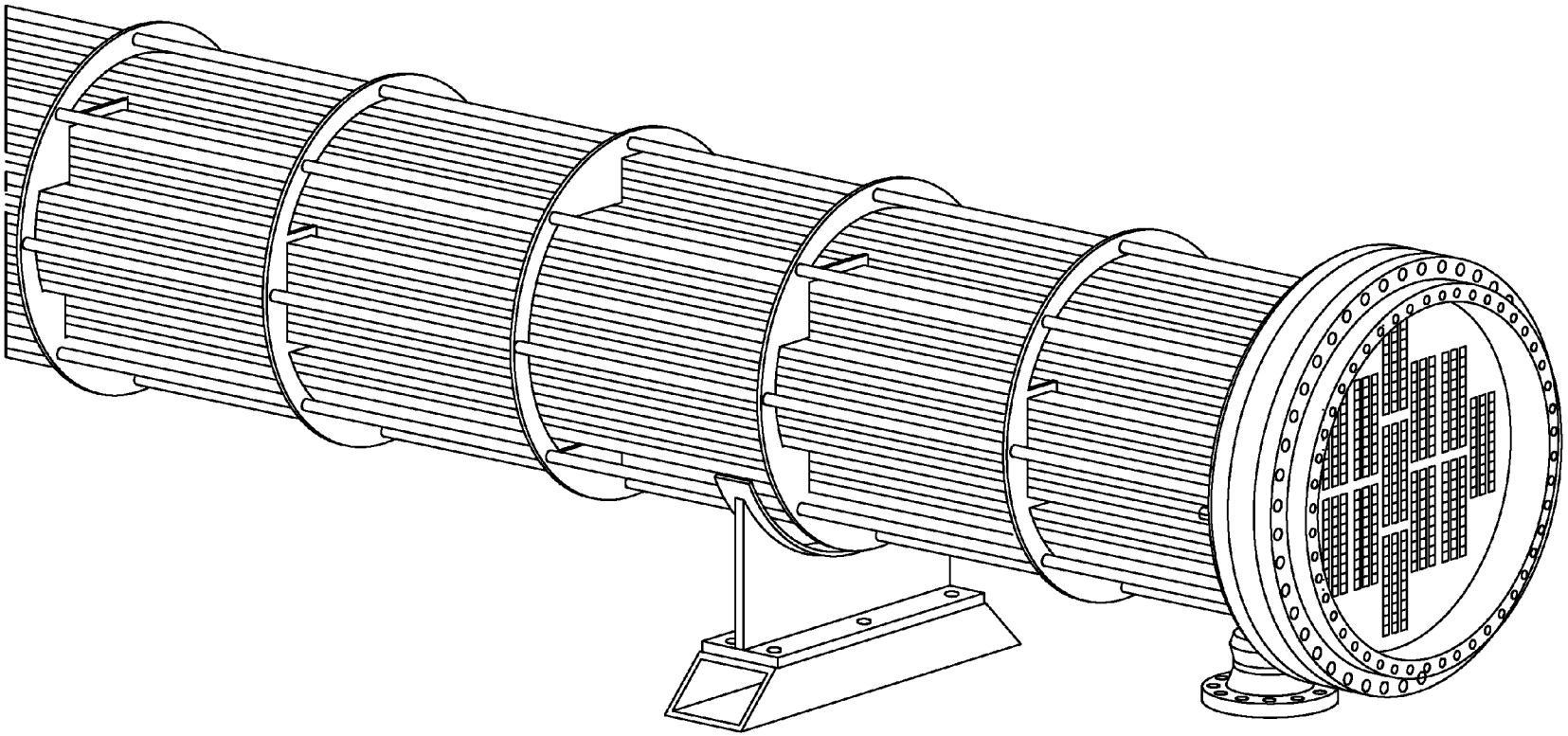
FIG. 8D shows an example of circular baffles with slots for passage of the tube bundle.
Figure 8E:
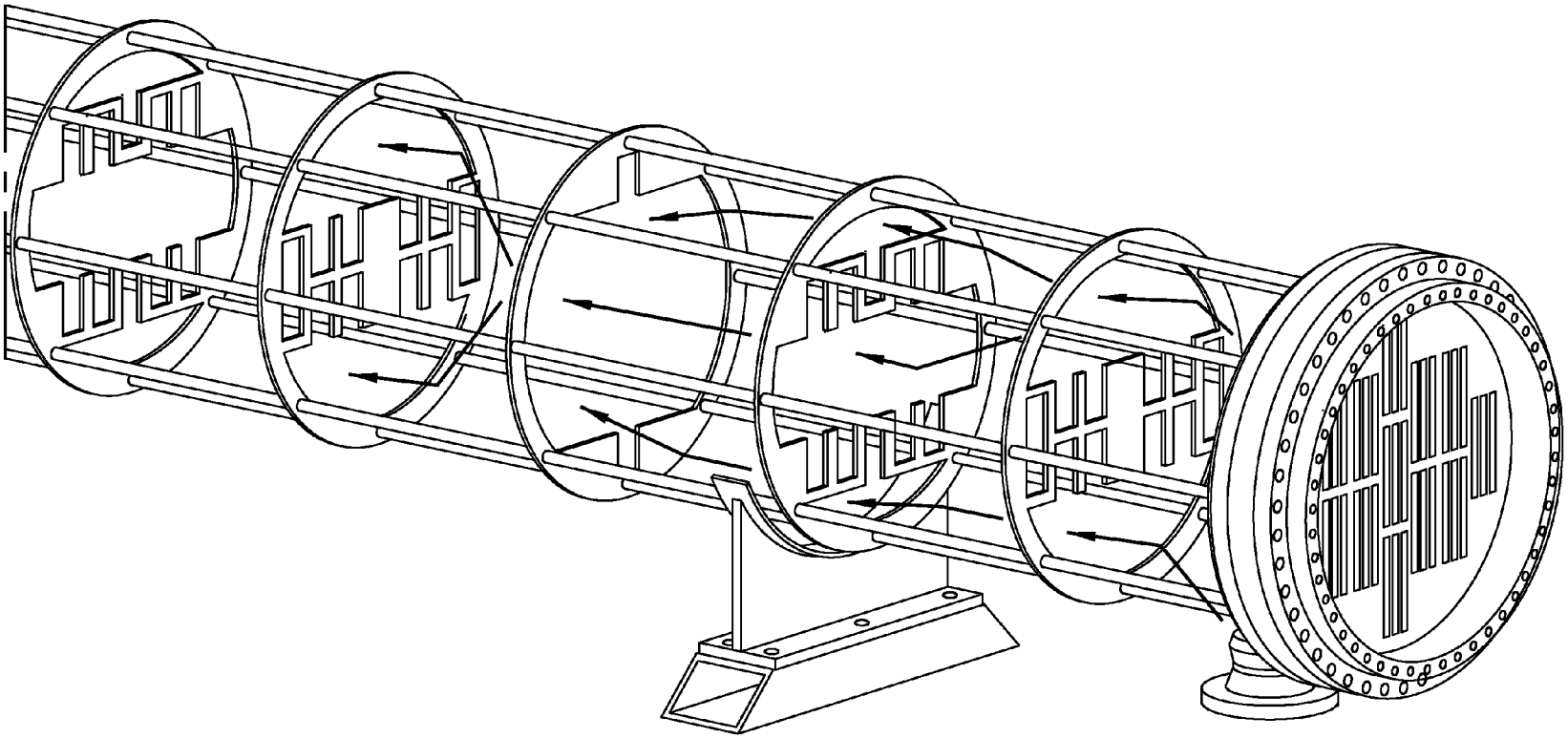
FIG. 8E is a view similar to FIG. 8D but with the tube bundle removed.

FIGS. 8D-E show circular baffles with cut-outs to allow passage of the tube bundle, with the arrows in FIG. 8E showing an approximation of the flow path of fluid past the baffles.

Figure 10:
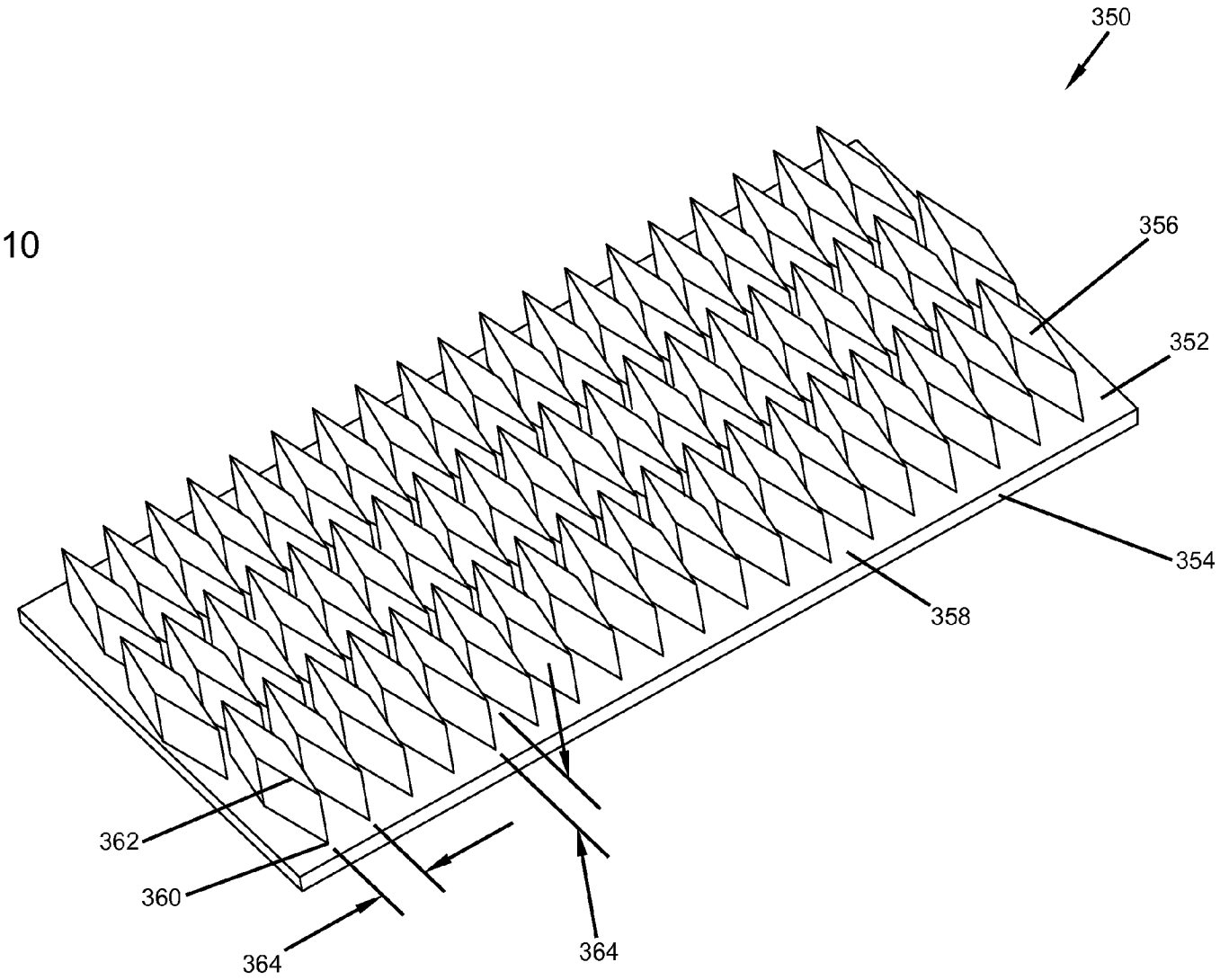
FIG. 10 shows another embodiment of a plate-fin heat exchange unit.

The foam fins described herein are not limited to being secured to plates that define flow channels. FIG. 10 shows an embodiment of a plate-fin heat exchange unit 350 with fins 352 having a diamond-shaped configuration. The fins 352 are joined to a plate 354 to form a thermal transfer path between a first fluid and a second fluid. The fins 352 and the plate 354 may be joined using bonding, welding, brazing, epoxy, and/or mechanical attachment.

The diamond-shaped fins 352 have a diamond shaped end surface 356, when viewed from the top perspective, which is substantially flat for stacking and for making contact with another surface, for example the surface of the plate of another heat exchange unit 350. The fins 352 are disposed on a major surface 358 of the plate 354, with each fin 352 having a first end 360 connected to and in thermal contact with the surface 358 of the plate 354. Each fin 352 has a second end 362 spaced from the surface 358 of the plate 354, where the end 362 defines the end surface 356. Fluid flow paths 364 are defined by the fins 352 and the plate 354.

As would be apparent to a person of ordinary skill in the art, the aspect ratio (i.e. the ratio of the longer dimension of the end surface 356 to its shorter dimension), the height, the width, the spacing and other dimensional parameters of the fins 352 can be varied depending in part upon the application and the desired heat transfer characteristics.

Figure 11:
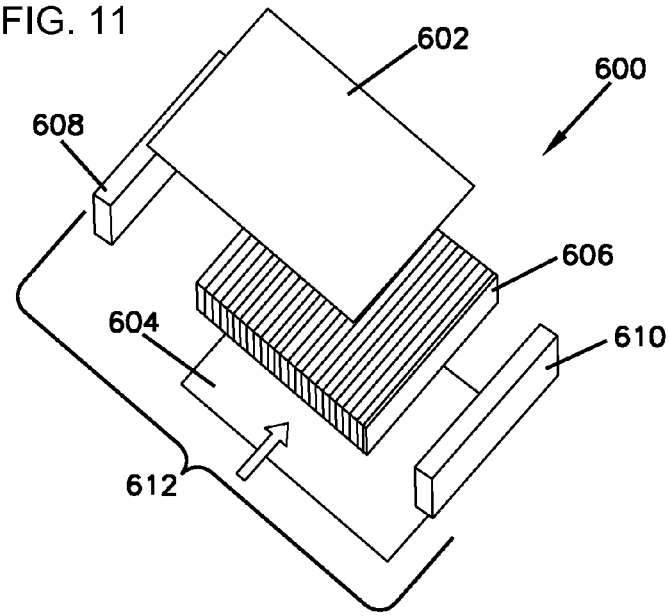
FIG. 11 shows another embodiment of a heat exchange unit.

FIG. 11 shows another embodiment of a plate-fin heat exchange unit 600. The heat exchange unit 600 includes a first plate 602 and a second plate 604 separated by a plurality of fins 606. The fins 606 are in thermal contact with the first plate 602 and the second plate 604. The fins 606 define a plurality of fluid paths for flow of a fluid. The embodiment of the heat exchange unit 600 shown in FIG. 11 also includes side plates 608, 610, such that the first and second plates 602, 604 and the side plates 608, 610 together define a frame 612, and the fins 606 are disposed inside the frame 612. In another embodiment, the fins 606 are disposed outside the frame 612, and connected to the first, second, or both plates 602, 604. In another embodiment, the fins 606 are disposed both inside and outside the frame 612.

Figure 12:
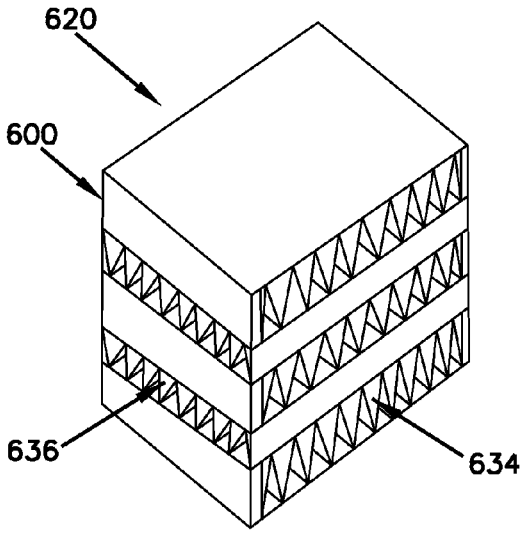
FIG. 12 shows an embodiment of stacked heat exchange units.

FIG. 12 shows a heat exchange stack 620 constructed from a plurality of the plate-fin heat exchange units 600 shown in FIG. 11. The units 600 are stacked on each other with each level rotated 90 degrees relative to an adjacent level. Therefore, the stack defines one or more fluid paths 634 in one direction, and one or more fluid paths 636 that extend in another direction approximately 90 degrees relative to the fluid paths 634. In the illustrated embodiment, the units 600 are arranged such that the fluid paths 634, 636 alternate with each other in a cross-flow pattern. A first fluid can be directed through the fluid paths 634 while a second fluid can be directed through the fluid paths 636 for exchanging heat with the first fluid in a cross-flow relationship. When stacked, each unit 600 can share a plate 602, 604 with an adjoining unit 600, or each unit 600 can have its own plates 602, 604.

Figure 13:
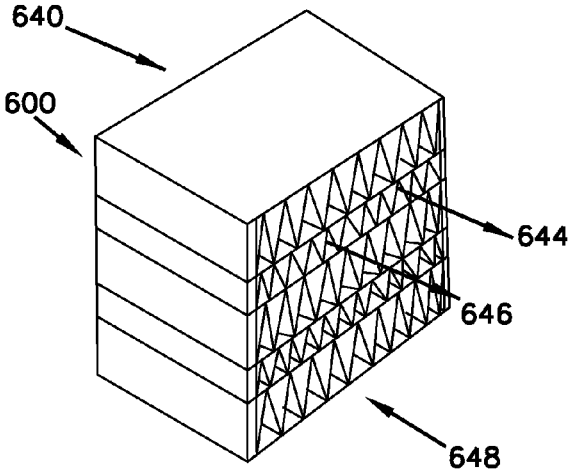
FIG. 13 shows another embodiment of stacked heat exchange units.

FIG. 13 shows a heat exchange stack 640 where the units 600 are arranged so that the fluid flow paths 644, 646 defined by each unit are parallel to one another. A first fluid can be directed through the fluid paths 644 while a second fluid can be directed through the fluid paths 646 for exchanging heat with the first fluid. The fluids in the paths 644, 646 can flow in the same directions (parallel or co-current flow) or, as shown by the arrow 648, they can flow in opposite directions (counter-current flow).

The plates in the illustrated embodiments have been rectangular or square plates. However, the fins can be used with plates of any shape, including but not limited to circular, elliptical, triangular, diamond, or any combination thereof, with the fins disposed on a plate (similar to FIG. 3-5 or 10) or disposed between plates (similar to FIGS. 11-13), within a shell or used without a shell. For example, the foam fins can be disposed between circular plates which are disposed within a shell, in a heat exchanger of the type disclosed in U.S. Pat. No. 7,013,963.

FIGS. 14A-M show additional embodiments of fin arrangements that can be used with the heat exchange units described herein. In all embodiments of fins arrangements in FIGS. 14A-M, various dimensional parameters of the fins such as the aspect ratio, spacing, height, width, and the like can be varied depending in part upon the application and the desired heat transfer characteristics of the fins and the heat exchange units.

Figure 14A:
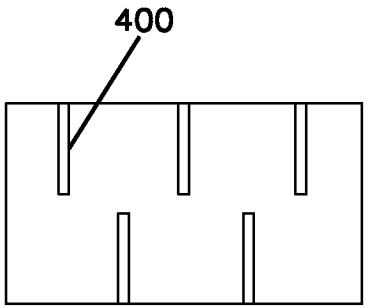
FIGS. 14A-M show additional embodiments of fin arrangements that can be used with the described heat exchange units.
Figure 14B:
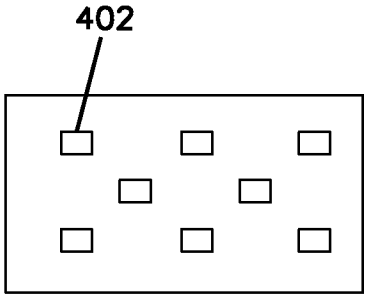
Figure 14C:
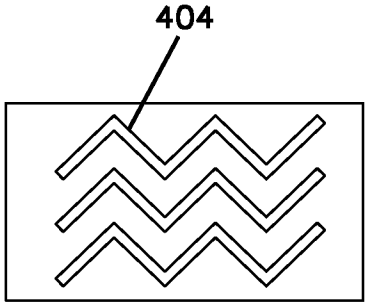

FIG. 14A shows a top view of fins 400 where the fins 400 are disposed in a baffled offset configuration. FIG. 14B shows a top view of another embodiment of fins 402 where the fins 402 are disposed in an offset configuration. When viewed from the top, each of the fins 402 may have the shape of, but not limited to, square, rectangular, circular, elliptical, triangular, diamond, or any combination thereof. FIG. 14C shows a top view of another embodiment of fins 404 where the fins 404 are disposed in a triangular-wave configuration. Other types of wave configurations, such as for example, square waves, sinusoidal waves, sawtooth waves, and/or combinations thereof are also possible.

Figure 14D:
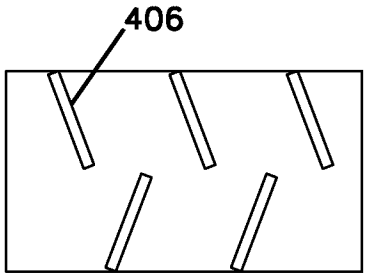
Figure 14E:
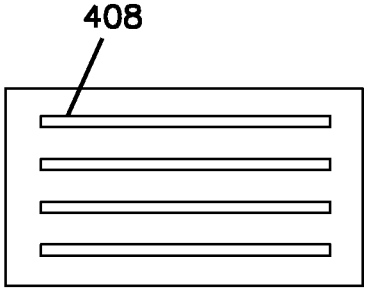
Figure 14F:
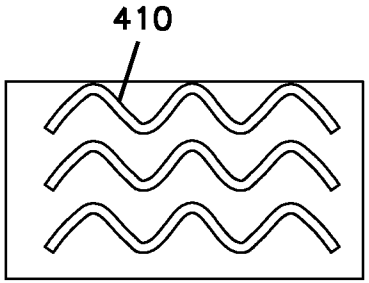

FIG. 14D shows a top view of another embodiment of fins 406 where the fins 406 are disposed in an offset chevron configuration. FIG. 14E shows a top view of an embodiment of fins 408 where the fins 408 are disposed in a rectangular linear configuration. FIG. 14F shows a top view of an embodiment of fins 410 where the fins 410 are disposed in a curved wave configuration. An example of the curved wave configuration is a sinusoidal wave configuration.

The configuration of the fins, when viewed from the top, does not necessarily define the direction of fluid flow. When viewing FIGS. 14A-F, one skilled in the art will understand that the direction of fluid flow past the fins can be from top to bottom, bottom to top, right to left, left to right, and any direction therebetween.

Figure 14J:
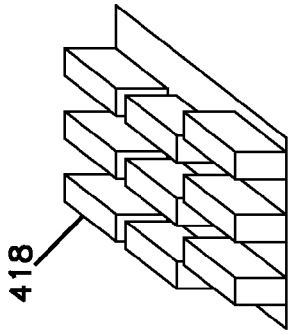
Figure 14I:
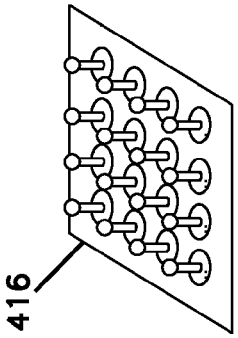
Figure 14H:
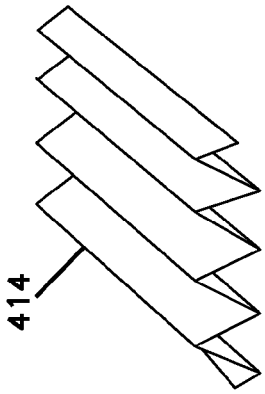
Figure 14G:
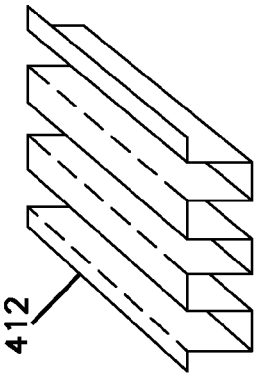

FIG. 14G shows fins 412 having rectangular cross-sectional shapes in a direction perpendicular to the plane defined by the plate of the heat exchange unit. FIG. 14H shows fins 414 having triangular cross-sectional shapes in a direction perpendicular to the plane defined by the plate of the heat exchange unit.

FIG. 14I shows fins 416 having pin-like shapes in a direction perpendicular to the plane defined by the plate of the heat exchange unit. A pin-like shape is used herein to mean a shape having a shaft portion and an enlarged head portion, wherein the head portion has a cross-sectional area that is larger than the cross-sectional area of the shaft portion. However, a pin-like shape can also encompass a shape having just a shaft portion without an enlarged head portion. When viewed from above, the fins 416 may have the shape of, including but not limited to, square, rectangular, circular, elliptical, triangular, diamond, or any combination thereof. The fins 416 can be formed by, for example, stamping the foam to form the pin-like shapes.

Figure 14M:
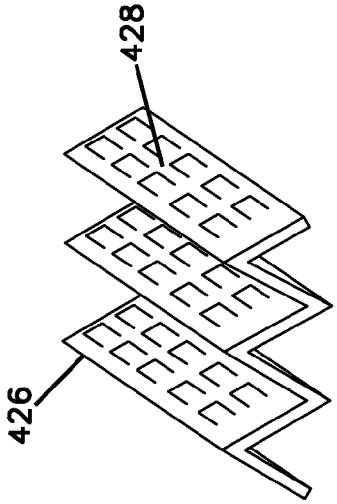
Figure 14L:
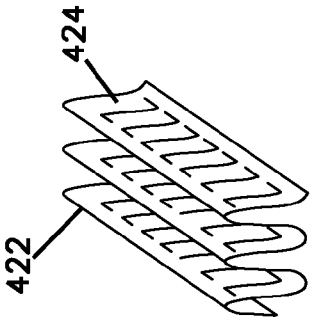
Figure 14K:
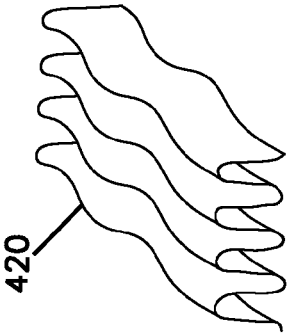

FIG. 14J shows fins 418 having offset rectangular fins. FIG. 14K shows fins 420 having wavy, undulating shapes. FIG. 14L shows fins 422 having louvered surfaces 424 that allow cross-flow of fluid between the channels defined along the main direction of the fins 422. FIG. 14M shows fins 426 having perforations 428 that allow cross-flow of fluid between the channels defined along the main direction of the fins.

One skilled in the art would understand that the various fin configurations described herein may be used in combination with each other and in any of the heat exchange units described herein, based on factors such as the flow regime, area and flow paths within the heat exchanger, as well as the application of the heat exchanger.

The heat exchangers described herein can be employed in any number of applications, including but not limited to, low thermal driving force applications such as Ocean Thermal Energy Conversion, power generation applications, and non-power generation applications such as refrigeration and cryogenics.

All of the heat exchangers described herein operate as follows. A first fluid flows past and is in contact with the fins on the fin side of the plate. Simultaneously, a second fluid is present on the opposite side of the plate. The second fluid can flow primarily counter to the first fluid, in the same direction as the first fluid, in a cross-flow direction relative to the flow direction of the first fluid, or any angle thereto. The first and second fluids are at different temperatures and therefore heat is exchanged between the first and second fluids. Depending upon the application, the first fluid can be at a higher temperature than the second fluid, in which case heat is transferred from the first fluid to the second fluid via the fins and the plate. Alternatively, the second fluid can be at a higher temperature than the first fluid, in which case heat is transferred from the second fluid to the first fluid via the plate and fins.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A plate-fin heat exchanger, comprising:

a housing;

a first metal facesheet within the housing and sealed to the housing, at least one opening extending through the first metal facesheet from a first side to a second side thereof;

a second metal facesheet within the housing and sealed to the housing, at least one opening extending through the second metal facesheet from a first side to a second side thereof, the second metal facesheet is spaced from the first metal facesheet in a longitudinal direction defining a chamber between the second side of the first metal facesheet and the second side of the second metal facesheet;

a first inlet to the chamber and a first outlet from the chamber for a first fluid;

a second inlet and a second outlet for a second fluid, the second inlet is in fluid communication with the first side of the first metal facesheet that faces away from the chamber and the second outlet is in fluid communication with the first side of the second metal facesheet that faces away from the chamber; and a plate-fin tube bundle disposed within the chamber, the plate-fin tube bundle includes a plurality of plate-fin heat exchange units, each plate-fin heat exchange unit includes:

an extruded metal plate that includes first and opposing major surfaces and first and second opposing ends, at least one enclosed fluid flow channel extending through the extruded metal plate from the first end to the second end thereof, the enclosed fluid flow channel does not extend through the first and second opposing major surfaces, the first end is friction stir welded to the first metal facesheet with the at least one enclosed fluid flow channel in fluid communication with the second inlet via the at least one opening in the first metal facesheet, and the second end is friction stir welded to the second metal facesheet with the at least one enclosed fluid flow channel in fluid communication with the second outlet via the at least one opening in the second metal facesheet; and a plurality of fins disposed on the first major surface, each fin having a first end connected to and in thermal contact with the first major surface and a second end spaced from the first major surface, each fin having a flat top surface at the second end thereof, the fins defining a plurality of fluid paths that extend generally from the second end to the first end thereof, a first gap between the fins and the first metal facesheet, a second gap between the fins and the second metal facesheet, the fins include graphite foam or metal foam, and the fluid paths defined by the fins are fluidically connected to the first inlet and the first outlet; and the plurality of the plate-fin heat exchange units are stacked together inside the chamber in direct contact with one another with the second ends of the fins of each plate-fin heat exchange unit joined to the second major surface of the extruded metal plate of an adjacent plate-fin heat exchange unit.

2. The plate-fin heat exchanger of claim 1, wherein the extruded metal plate of each plate-fin heat exchange unit includes a plurality of the enclosed fluid flow channels extending therethrough from the first end to the second end thereof, the first metal facesheet has a plurality of the openings formed therein with the plurality of the enclosed fluid flow channels in each extruded metal plate in fluid communication with the second inlet via the plurality of the openings in the first metal facesheet, and the second metal facesheet has a plurality of the openings formed therein with the plurality of the enclosed fluid flow channels in each extruded metal plate in fluid communication with the second outlet via the plurality of the openings in the second metal facesheet.

3. The plate-fin heat exchanger of claim 1, wherein the fins consist essentially of graphite foam.

4. The plate-fin heat exchanger of claim 1, wherein the fins are arranged on the first major surface of each extruded metal plate into a plurality of fin regions with a gap between each fin region and the fin regions are spaced from each other in the longitudinal direction.

5. The plate-fin heat exchanger of claim 1, wherein the first end of each fin is bonded to the first major surface of each extruded metal plate with a thermally conductive adhesive or brazed to the first major surface.

6. The plate-fin heat exchanger of claim 1, wherein the first end of each fin is bonded to the first major surface of each extruded metal plate with a thermally conductive adhesive, and conductive ligaments are disposed within the thermally conductive adhesive, the conductive ligaments being in intimate contact with the first major surface of the extruded metal plate.

7. The plate-fin heat exchanger of claim 1, further comprising baffling within the chamber for directing fluid flow past the fins of the plate-fin heat exchange units.

8. The plate-fin heat exchanger of claim 7, wherein the baffling comprises a plurality of baffle plates secured to the plate-fin tube bundle and spaced along the length thereof.

9. The plate-fin heat exchanger of claim 1, wherein the fins are made of graphite foam, and further comprising fins made of metal foam and/or fins made of metal.

* * * * *